US005906319A

United States Patent [19]

Crowl

[11] Patent Number: 5,906,319

[45] Date of Patent: May 25, 1999

[54] WATER/SOAP SPRAYER FOR KITCHEN FAUCETS

[76] Inventor: Ronald D. Crowl, 215 Kenmore Ave., Council Bluffs, Iowa 51503

[21] Appl. No.: 08/824,953

[22] Filed: Mar. 27, 1997

[51] Int. Cl.[6] ..... B05B 7/04

[52] U.S. Cl. ..... 239/310; 239/318; 239/415

[58] Field of Search ..... 239/310, 318, 239/415, 414, 578

[56] References Cited

U.S. PATENT DOCUMENTS

| | | | |
|---|---|---|---|
| 2,616,660 | 11/1952 | Morehouse | 239/318 X |
| 2,848,728 | 8/1958 | Graff et al. | 239/318 X |
| 2,934,314 | 4/1960 | Chambers et al. | 239/318 X |
| 2,975,804 | 3/1961 | Dunn et al. | 239/318 X |
| 3,154,101 | 10/1964 | Cravits | 239/318 X |
| 3,581,998 | 6/1971 | Roche | 239/415 |

*Primary Examiner*—Lesley D. Morris
*Attorney, Agent, or Firm*—Adam H. Jacobs

[57] ABSTRACT

A water/soap sprayer for attachment to a kitchen faucet includes a sprayer unit having a handle section and a nozzle section having an outflow nozzle end. A water flow conduit extends through the sprayer unit for transferring water through the sprayer unit and to the outflow nozzle end, the water flow conduit including a Venturi passage section for accelerating fluid flow therethrough. A detergent flow conduit extends through the sprayer unit and is connected in fluid connection with the Venturi passage section of the water flow conduit within the sprayer unit. A water flow control valve is mounted within the sprayer unit, the water flow control valve operative to restrict and permit water flow through the water flow tube, the water flow control valve in the water flow conduit positioned upstream from the Venturi passage section of the water flow conduit. A detergent flow control valve is mounted within the sprayer unit, the detergent flow control valve operative to restrict and permit detergent flow into the Venturi passage section of the water flow conduit. A flexible water supply conduit and a flexible detergent supply conduit are connected, respectively, to the water flow conduit and the detergent flow conduit and respectively to a water source and a detergent repository. The sprayer unit is operative to clean items by actuation of the water flow control valve and the detergent flow control valve whereby a water/detergent mix is output through the nozzle section of the sprayer unit.

10 Claims, 5 Drawing Sheets

WATER/SOAP SPRAYER FOR KITCHEN FAUCETS

BACKGROUND OF THE INVENTION

1. Technical Field

The present invention relates to water and soap dispensers for kitchen faucets and, more particularly, to a water/soap sprayer which includes a nozzle and handle combination, the handle including individual controls for water and detergent flow, a nozzle including a removable cleaning brush, the handle being further connected to a water source and a detergent source.

2. Description of the Prior Art

Since the invention of the dish, there has been a need for a simple and efficient way to clean them. Dish towels, sponges, rags, brushes, and steel wool have all been used for many years with varying degrees of success. With the advent of the dishwasher, many of the problems encountered in cleaning dishes were apparently solved. However, dishwashers to this day remain expensive and cannot be used in many older homes or apartments without major structural modification of the kitchen area. Also, there are numerous other cooking and serving devices which cannot be cleaned in a dishwasher, including electric frying devices, china, crystal, roasting pans, cookie sheets and assorted other dinnerware and cookware. Therefore, while a dishwasher remains one of the best dish cleaning tools available, there remains an unfulfilled need for a tool that can accompany a dishwasher or take the place of a dishwasher where no dishwasher is present. The search is thus continued for an easily operable and efficient cleaning device.

Several examples are found in the prior art which disclose improvements of dish cleaning devices. For example, Gottwald, et al., U.S. Pat. No. 4,662,768, discloses a hand held kitchen sink spray apparatus with cleaning attachments attached by a quick-release connector. Various brushes and nozzles may be fitted onto the head of the sprayer unit in order to provide different types of cleaning (i.e., water spray, brush, etc.) Several other patents found in the prior art also disclose sink sprayer heads and/or attachments thereto, including Shames, et al., U.S. Design Pat. No. 288,228 and Nicholson, U.S. Design Pat. No. 317,988. It should be noted that none of these references, however, include a means for dispensing soap from the cleaning device, thus requiring that the user of the device add soap from a soap dispenser or the like. There is therefore a need for a sink sprayer which will be capable of dispensing detergent soap in addition to dispensing water therefrom.

Improved attempts at solving the problem of washing dishes are found in the prior art also, including such devices as Manville, U.S. Pat. No. 2,508,958 and Weber, U.S. Pat. No. 2,540,064. Both of these inventions provide improvements over the dish washing devices found previously, yet each include inherent drawbacks. Specifically, while both Manville and Weber disclose dispensing means for liquid soap, neither device includes any means whatsoever to prevent water flow through the system except by turning off the water at the faucet or deactivating the diverter valve which is located on the faucet. This design flaw is unacceptable for several reasons, the most important being that when an individual is cleaning a dish within the sink, one hand will be supporting the dish itself while the other hand is using the cleaning device to clean the dish. As the majority of people in this world only have two hands, the individual cleaning the dish cannot shut off the water flow without setting the dish down. Of course, when the dish is set down, it may become dirty again if water remains in the sink, thus rendering the entire cleaning process meaningless. There is therefore a need for a sink sprayer which includes a cutoff valve for the water on the handle of the sink spray unit itself.

Finally, the position of any such cutoff valve for water on the handle of the sink sprayer unit must be such that it will not interfere with the dispensing of soap into the water stream. Many of the sprayers presently used include a water cutoff valve directly adjacent the nozzle of the sprayer unit. Clearly, the positioning of the water cutoff valve in such a manner would interfere with the placement of any detergent addition mechanism within the sprayer unit. There is therefore a need for a sprayer unit designed such that the water cutoff valve and detergent flow valve will not interfere with the operation of each other.

Therefore, an object of the present invention is to provide an improved water/soap sprayer for kitchen faucets.

Another object of the present invention is to provide a water/soap sprayer for kitchen faucets which includes separate and individually operable water cutoff and detergent dispensing valves.

Another object of the present invention is to provide a water/soap sprayer for kitchen faucets which includes a detergent and water mixing chamber operative to enable the sprayer to dispense a water/detergent combination through a single nozzle.

Another object of the present invention is to provide a water/soap sprayer for kitchen faucets which can be quickly and easily fitted to existing faucets or can be installed on any faucet with a sprayer connection.

Another object of the present invention is to provide a water/soap sprayer for kitchen faucets in which the valves for the water cutoff and detergent dispenser may be operated by use of a single finger or thumb.

Another object of the present invention is to provide a water/soap sprayer for a kitchen faucet which includes a nozzle, a handle and two fluid delivery tubes extending into the handle end and connected, respectively, to a detergent dispensing repository position under the sink and a water dispensing spigot.

Another object of the present invention is to provide a water/soap sprayer for a kitchen faucet which includes a nozzle to which attachments may be removed or connected, including such devices as brushes, spray directors, and other such attachments.

Finally, an object of the present invention is to provide water/soap sprayer for a kitchen faucet which is relatively simple and inexpensive to manufacture and safe and efficient in use.

SUMMARY OF THE INVENTION

The present invention provides a water/soap sprayer for attachment to a kitchen faucet which includes a sprayer unit having a handle section and a nozzle section having an outflow nozzle end. A water flow conduit extends through the sprayer unit for transferring water through the sprayer unit and to the outflow nozzle end, the water flow conduit including a Venturi passage section for accelerating fluid flow therethrough. A detergent flow conduit extends through the sprayer unit and is connected in fluid connection with the Venturi passage section of the water flow conduit within the sprayer unit. A water flow control valve is mounted within the sprayer unit, the water flow control valve operative to restrict and permit water flow through the water flow tube, the water flow control valve in the water flow conduit positioned upstream from the Venturi passage section of the water flow conduit. A detergent flow control valve is mounted within the sprayer unit, the detergent flow control valve operative to restrict and permit detergent flow into the Venturi passage section of the water flow conduit.

A water flow control valve actuating device such as a lever is mounted on the sprayer unit for actuating and controlling the water flow control valve, and a detergent flow control valve actuating device is mounted on the sprayer unit for actuating and controlling the detergent flow control valve. A flexible water supply conduit is connected at one end thereof to the water flow conduit opposite the outflow nozzle end of the nozzle section and is adapted for connection at the opposite end thereof to a water source. Similarly, a flexible detergent supply conduit is connected at one end thereof to the detergent flow conduit opposite the connection to the Venturi passage section of the water flow conduit, the opposite end of the detergent supply conduit adapted for connection to a liquid detergent source. The sprayer unit is operative to clean items by actuation of the water flow control valve and the detergent flow control valve whereby a water/detergent mix is output through the nozzle section of the sprayer unit and out of the sprayer unit through the outflow nozzle end.

As thus described, the water/soap sprayer of the present invention provides numerous advantages over those devices found in the prior art. For example, because the present invention can be quickly and easily connected to a standard faucet, it can be used in far more situations than those devices found in the prior art. Furthermore, because the present invention includes both a water flow control valve and a detergent flow control valve on the handle unit of the sprayer itself, the device may be more easily and efficiently used than other devices used previously. Finally, because the device may be operated by use of only a single digit with the device held in only one hand, a user can easily hold a dish in one hand while using the present invention to clean the dish. It is thus seen that the present invention provides a substantial improvement over those devices found in the prior art.

DESCRIPTION OF THE PREFERRED EMBODIMENT

Figure 1:
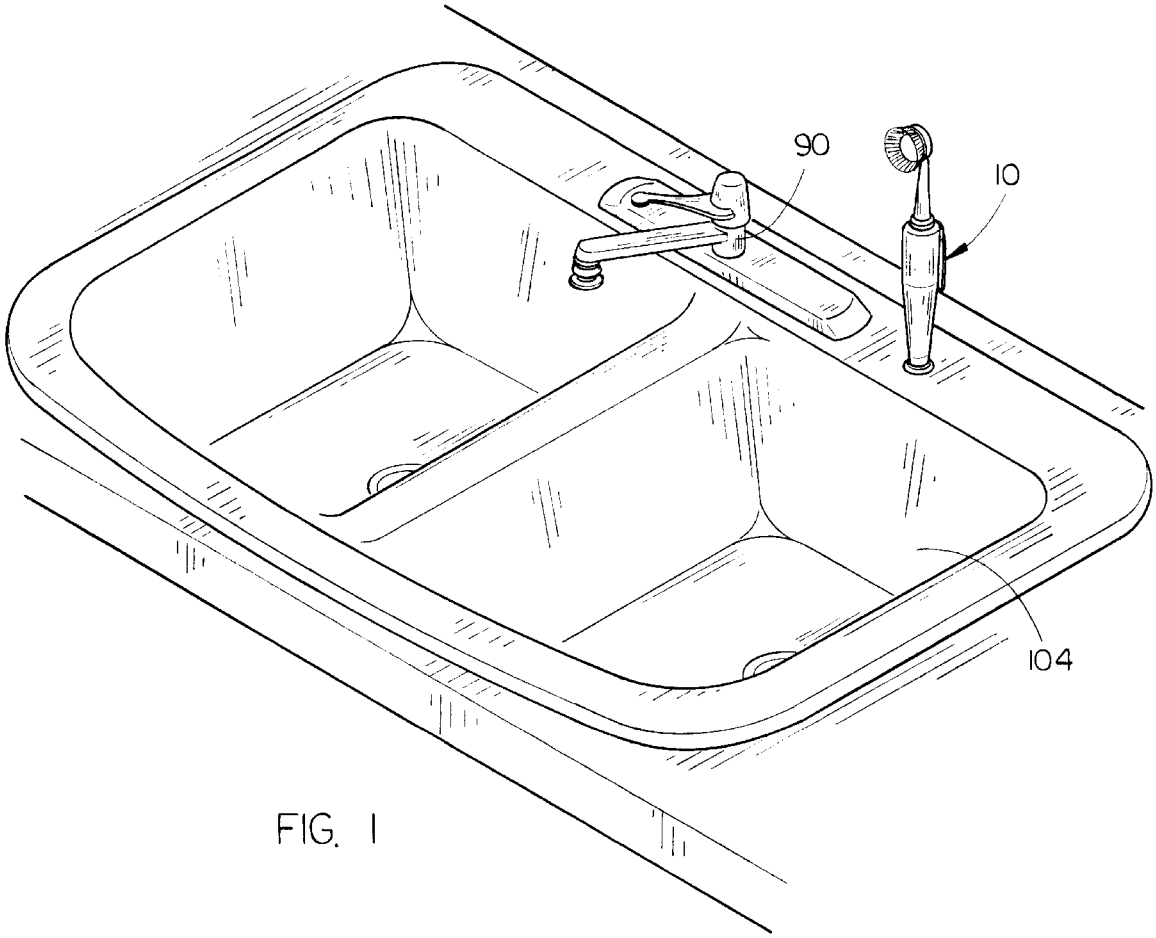
FIG. 1 is a perspective view of the water/soap sprayer for kitchen faucets of the present invention mounted adjacent a standard kitchen sink.
Figure 3:
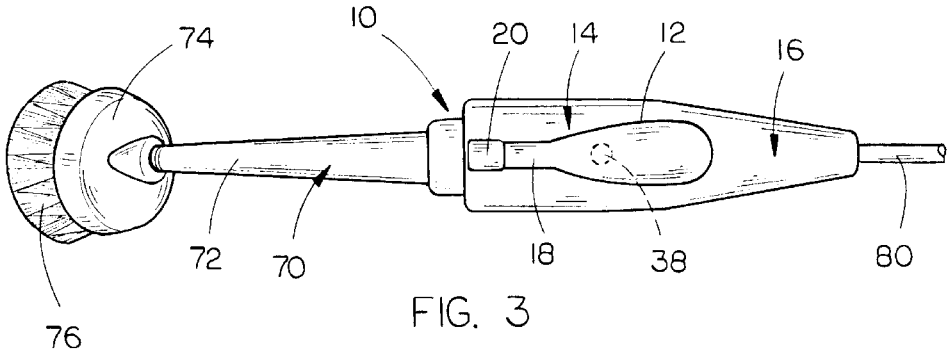
FIG. 3 is a top plan view of the sprayer unit showing the handle section and nozzle section.

The water/soap sprayer 10 of the present invention is best shown in FIGS. 1–5*c* as including a generally cylindrical handle section 12 and a generally conical nozzle section 70. As shown best in FIG. 3, handle section 12 preferably includes a generally cylindrical forward section 14 and a tapering conical rear section 16. In the preferred embodiment, the overall length of the water/soap sprayer 10 will be between 4" and 12". Of course, the exact shape and size of the handle section 12 is not critical to the invention so long as the handle section may be easily grasped by a user of the water/soap sprayer 10. It is further preferred that handle section 12 be constructed of a medium-weight rigid plastic which may be constructed using any acceptable molding process. Handle section 12 may be hollow in order to further decrease weight and to contain the various internal elements of the water/soap sprayer 10 which will be described in detail below. However, as will be seen below, it is important that no matter what the exact physical characteristics of the handle section 12, the internal elements of the water/soap sprayer 10 must be supported within the water/soap sprayer 10 in certain operating positions.

Figure 2:
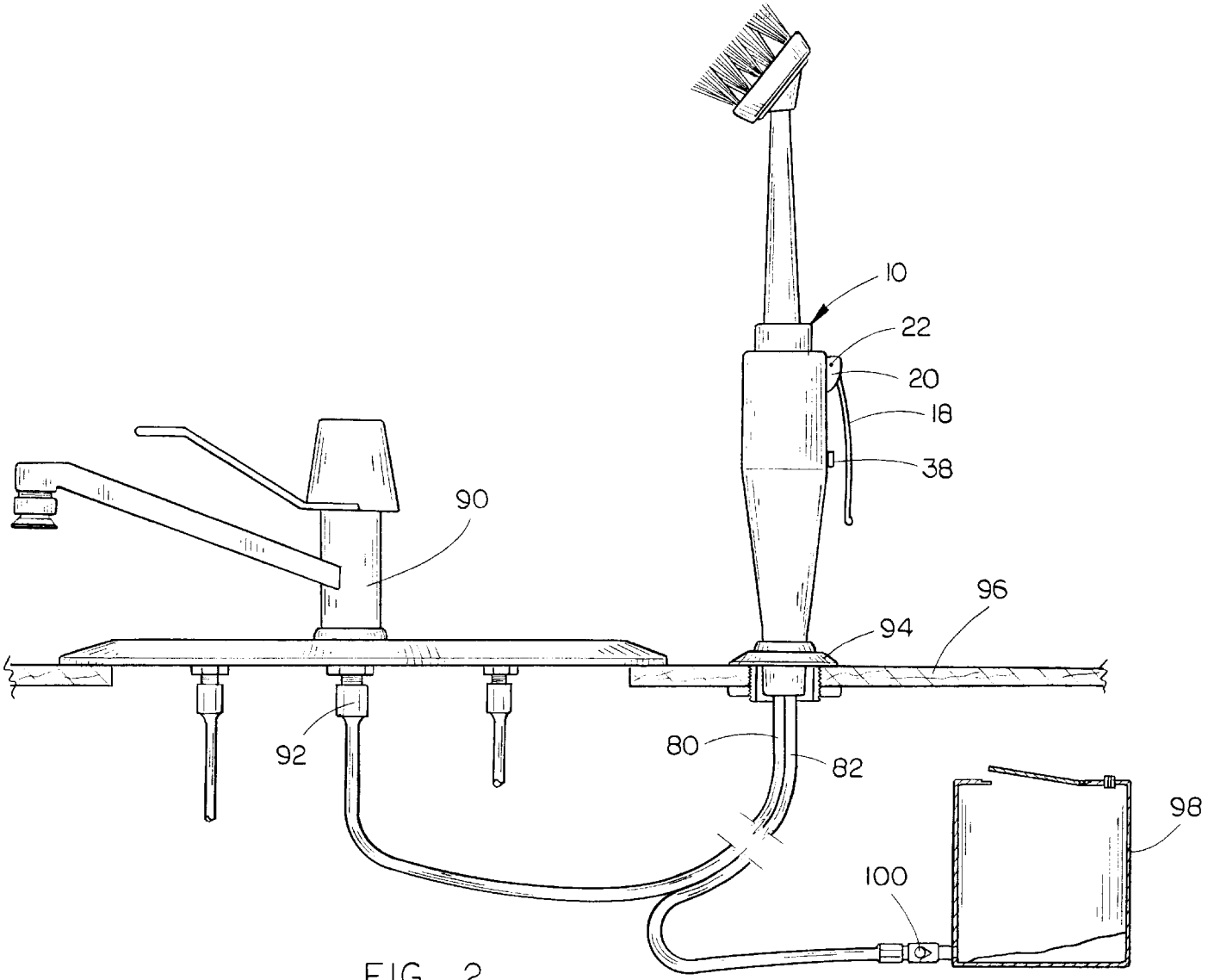
FIG. 2 is a side elevational cut away view of the sprayer unit and hoses connected to a faucet and the detergent dispensing repository.

Pivotably mounted on handle section 12 on forward section 14 thereof is a water flow control valve lever 18, the lever 18 mounted in lever mount bracket 20, which is preferably a generally U-shaped mounting structure mounted on and extending outward from handle section 12 as shown best in FIG. 2. Lever 18 is preferably mounted within lever mount bracket 20 with a pin 22 extending through the mounting end of lever 18 and into the opposite walls of level mount bracket 20. In this manner, lever 18 may be pivoted about pin 22. Lever 18 preferably is wider on the rearward end thereof so that a user of the water/soap sprayer 10 can easily use the lever even with wet, soapy fingers. Lever 18 may also be constructed as including the curved cross-section as shown and may be constructed of plastic or the like, although the exact size, shape and construction of the lever 18 is not critical to the present invention.

Figure 5A:
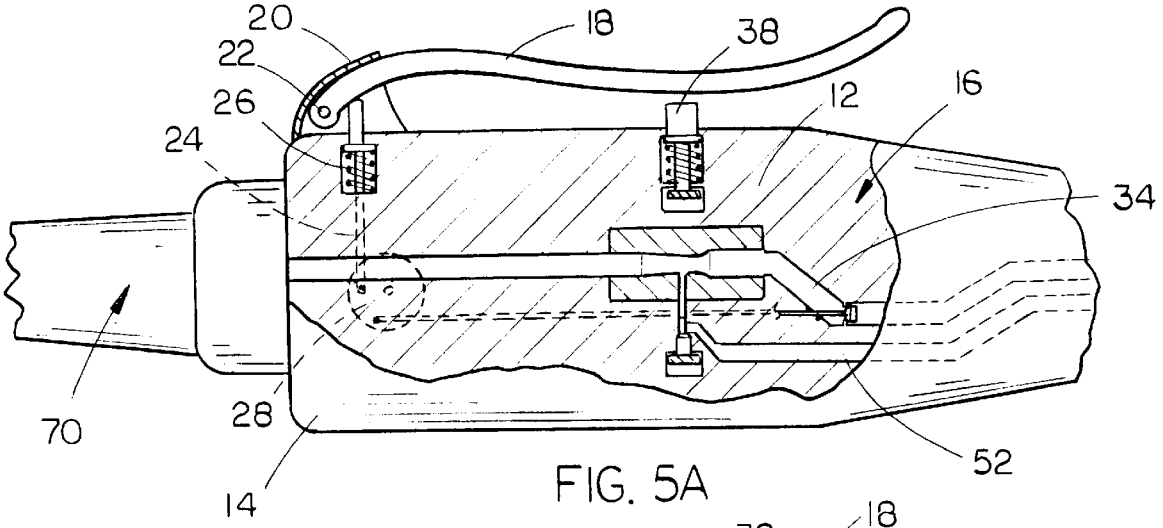
FIGS. 5*a*, 5*b*, and 5*c* are partial side elevational detail views of the sprayer unit, FIG. 5*a* showing the sprayer not in use, FIG. 5*b* showing the sprayer unit with the water valve engaged but the soap valve not engaged and FIG. 5*c* showing the sprayer with both valves engaged.
Figure 5B:
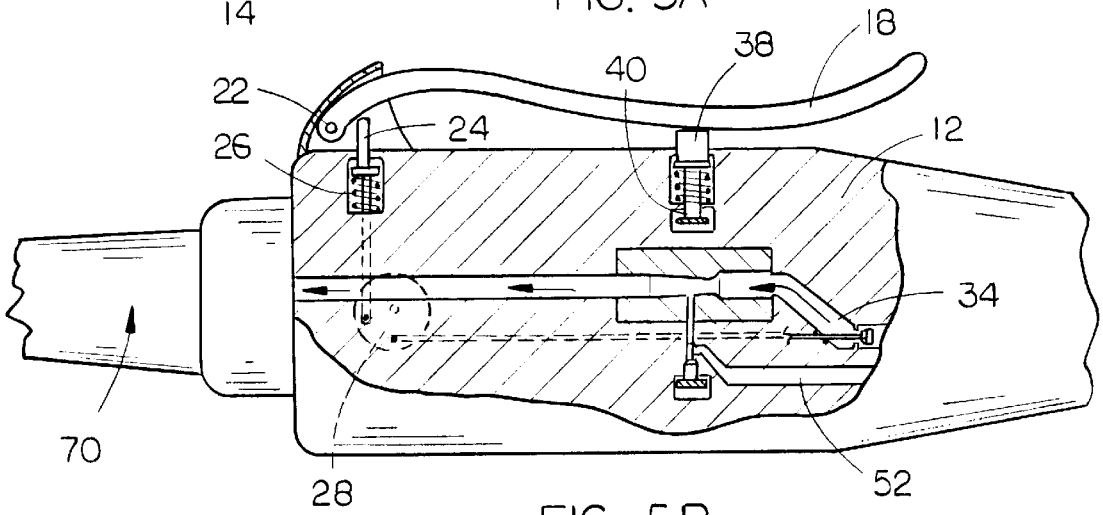
Figure 5C:
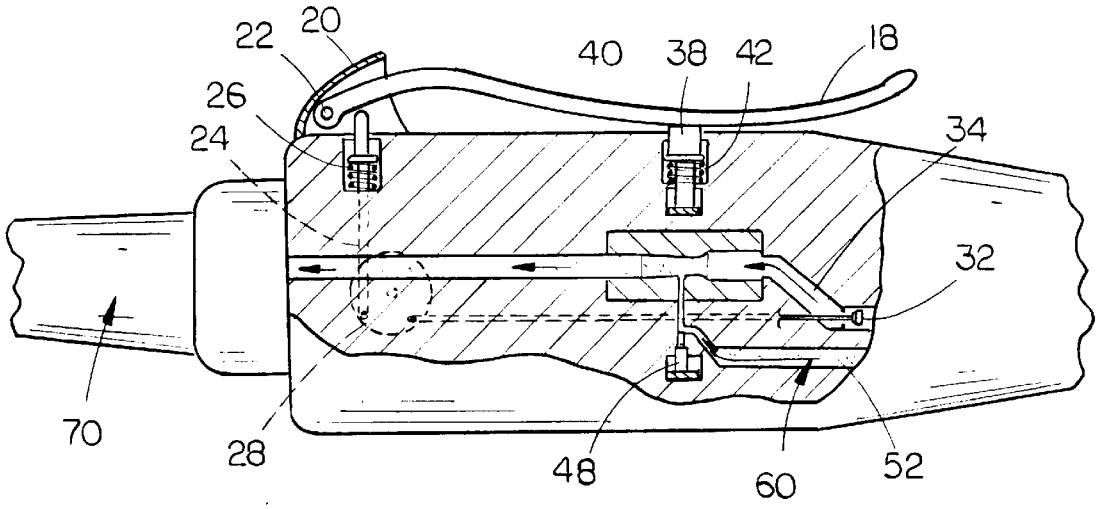

FIGS. 5*a*–5*c* best illustrate the internal components of handle section 12, which includes both a water flow control valve 23 and a detergent flow control valve 36. Positioned underneath lever 18 is a water valve control rod 24 which is movably mounted generally perpendicular to the axis of rotation of lever 18 such that as lever 18 is depressed, control rod 24 is likewise depressed. Control rod 24 preferably is mounted on a spring 26 which biases control rod 24 upwards and thus pivots lever 18 about lever pin 22 in an upwards direction. The lower end 27 of control rod 24 is preferably pivotably connected to a force transference wheel 28 as shown in FIGS. 5*a*–5*c*. Wheel 28 is rotatably mounted in handle section 12 such that the axis of rotation is generally parallel with the axis of rotation of lever 18. It is preferred that the connection of lower end 27 of control rod 24 to wheel 28 be on the forward part of the wheel 28, as shown in FIG. 5*a*. Pivotably connected to the wheel 28 on the lower part thereof is valve rod 30 which extends rearward from wheel 28 to contact plunger 32 which serves to permit or restrict water flow. The pivotable connections of control rod 24 and valve rod 30 to wheel 28 are preferably spaced approximately 90° apart such that vertical movement of control rod 24 rotates wheel 28 which translates the vertical force from rod 24 into a generally horizontal force applied to valve rod 30, thus moving valve rod 30 forwards and rearwards within handle section 12. As shown in FIG. 5*a*, control rod 24 is fully extended upwards due to spring 26 and, therefore, wheel 28 is in nonrotated position so that valve rod 30 is fully forward. Plunger 32 is thus seated against annular ring 33 formed within water flow tube 34 and therefore prevents water flow through water flow tube 34. As shown best in FIG. 5*b*, when water flow control valve lever 18 is depressed, control rod 24 is depressed downward thus rotating the force transference wheel 28 which causes valve rod 30 to be moved rearward. Plunger 32 is moved rearwards away from its seated position on annular ring 33 to an open position which allows for water flow through water flow tube 34. Of course, the water flow control valve as thus described may be changed or modified in any appropriate manner, including replacement of the wheel 28 with another force translation device such as a cog and gear mechanism or an L-shaped section of angled material and movement of the spring to a different location in the valve system, so long as the main function of restricting or permitting water flow is realized.

Figure 4A:
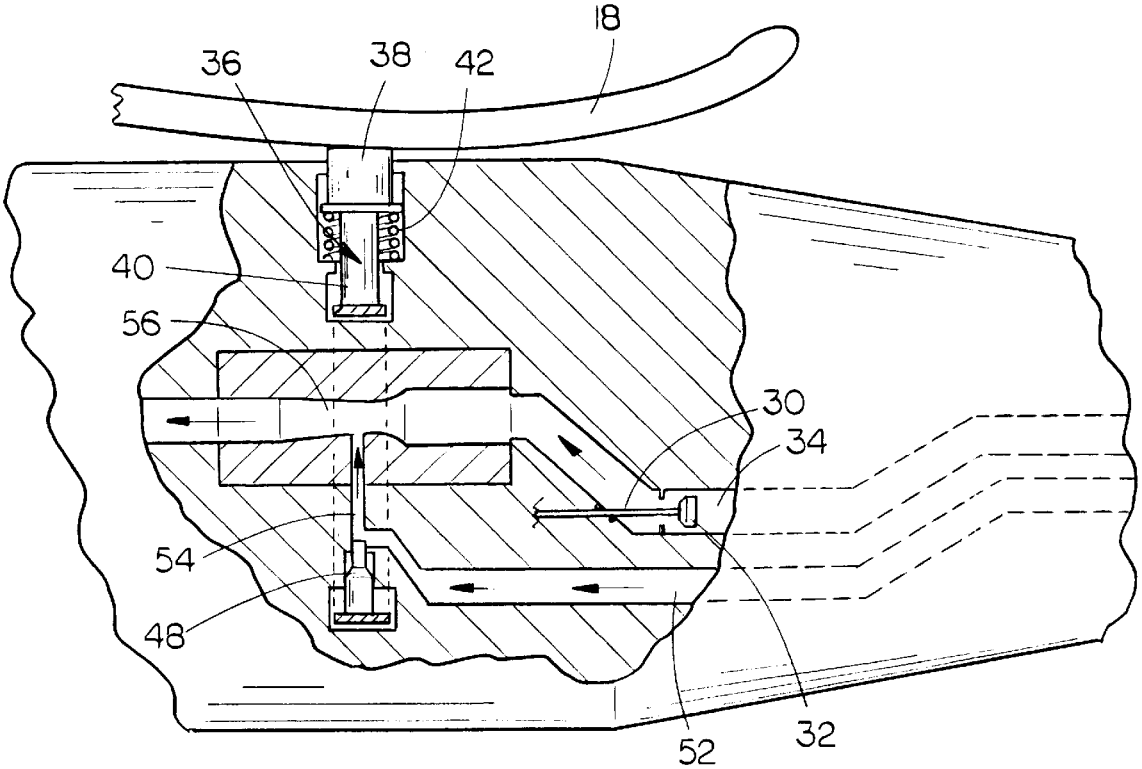
FIG. 4*a* is a partial side elevational detail view of the handle of the sprayer unit showing the narrowed Venturi section of the water tube and connection thereinto of the detergent dispensing tube.
Figure 4B:
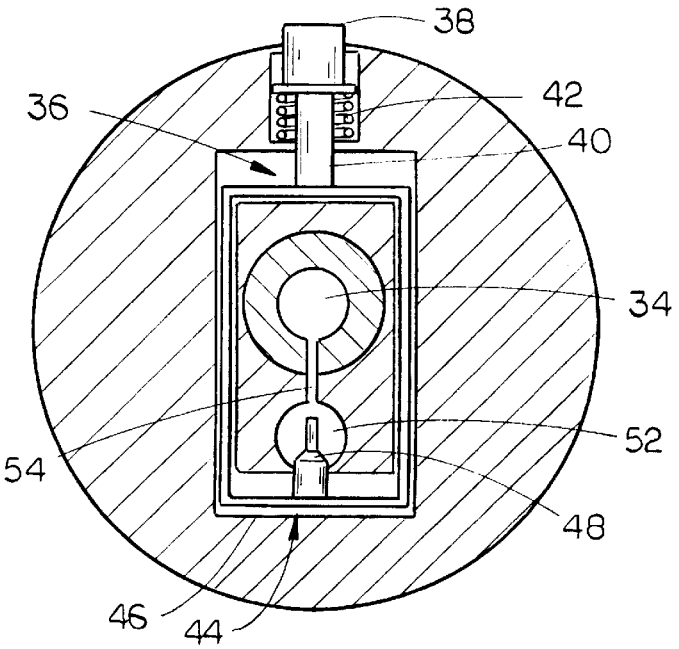
FIG. 4*b* is a partial end elevational detail view showing the operational features of the detergent flow control valve.

Detergent control valve 36 is shown best in FIGS. 4*a*–5*c* as including a button 38 mounted atop a detergent valve rod 40 which extends downwards through handle section 12. Preferably mounted underneath button 38 and surrounding valve rod 40 is a spring 42 which acts to bias valve rod 40 upwards, thus extending button 38 above the exterior of handle section 12. The valve rod 40, which in the preferred embodiment is a forked rod having left and right branches which extend downwards around the water flow tube 34 and detergent flow tube 52, extends downwards to contact needle valve assembly 44 which includes a base bar 46 which projects to the sides of needle valve assembly 44 to allow the left and right branches of valve rod 40 to engage and connect to base bar 46 without interfering with the operation of needle valve assembly 44. Needle valve assembly 44 preferably further comprises an upwardly projecting generally conical stopper 48 mounted on base bar 46 in the approximate middle thereof. The base bar 46, through its connection to valve rod 40, is biased upwards by spring 42, which thus biases stopper 48 upwards. Detergent flow tube 52 extends through handle section 12 and includes a narrowed portion which connects with water flow tube 34 as best shown in FIG. 4*b*. Conical stopper 48 extends into this narrowed opening 54 and seals the opening when the stopper 48 is biased upwards by spring 42. In this manner, detergent flow through detergent flow tube 52 is restricted. To permit detergent flow through detergent flow tube 52, button 38 is depressed by contact with water flow control valve lever 18 as shown in FIGS. 4*a*, 4*b* and 5*c*, the depression of button 38 moving valve rod 40 downwards. As valve rod 40 is moved downwards, base bar 46 is likewise moved downwards, thus moving conical stopper 48 downwards and allowing detergent flow through narrow opening 54 into water flow tube 34. Upon release of pressure on button 38, spring 42 biases upwards, thus reseating stopper 48 within narrow opening 54 and preventing further detergent flow.

As shown best in FIG. 4*a*, the detergent flow tube 52 connects to the water flow tube 34 at approximately the mid-point of the detergent mixing section 56 of the water flow tube 34, which in the preferred embodiment is a Venturi passage section 56. The Venturi passage section 56 is preferably a narrowed section of water flow tube 34 in which the diameter of the water flow tube 34 is decreased so that the volume of water tube 34 at Venturi passage section 56 is decreased. The dynamics of fluid flow are such that a fluid flowing through a narrowing passage will accelerate and flow faster through the narrowed portion of the fluid passage. In the present invention, water flowing through the Venturi passage section 56 accelerates through the passage and then slows down again on the opposite side of the Venturi passage section 56. Under these conditions, water flowing under pressure through the Venturi passage section 56 will create a measure of negative pressure or suction within the Venturi passage section 56 and, therefore, will create a region of suction in the Venturi passage section 56 around the narrow opening 54 of detergent flow tube 52 into water flow tube 34. When conical stopper 48 is removed from narrow opening 54 as described previously, detergent 60 is permitted to flow into the water flow tube 34 through narrow opening 54. The suction created by the Venturi passage section 56 draws detergent 60 through the narrow opening 54 and into water flow tube 34 such that a water/detergent mix continues onwards through water flow tube 34 and out through nozzle section 70. When button 38 controlling detergent flow control valve 36 is released, conical stopper 48 is reseated in narrow opening 54, detergent flow through detergent flow tube 52 is restricted and therefore, a stream of rinse water free of detergent 60 may flow through water flow tube 34 for the rinsing of dishes or the like.

In the preferred embodiment, as shown best in FIG. 2, water flow tube 34 extends outward through the base of rearward section 16 of handle section 12 of the water/soap sprayer 10 and extends as a flexible water supply conduit 80 to connect to a standard kitchen faucet 90 at the third water outlet of a kitchen faucet 90 designed for connection to a water sprayer such as those found in the prior art. The connection of the water supply conduit 80 to the faucet 90 may be by any appropriate means, although it is preferred that a threaded nut and gasket connection 92 such as that shown in FIG. 2 be used to provide the connection for water supply conduit 80. Of course, the water supply conduit 80 may be connected to any desired water source by any of the means commonly used in the art of plumbing, but it is preferred that the above-described connection system be used in order to provide a simple and efficient method of connecting the water/soap sprayer 10 of the present invention to a kitchen faucet 90. The flexible tube may be constructed of any suitable material, although PVC or rubber tubing may be preferable.

Figure 6:
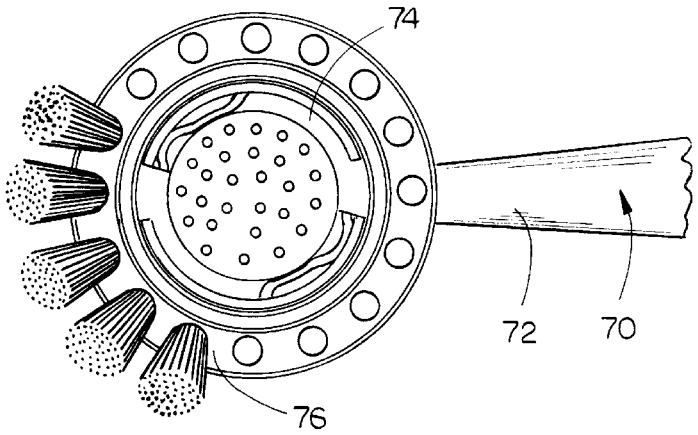
FIG. 6 is a front elevational detail view of the brush head on the nozzle end of the sprayer unit showing the detachable characteristics of the brush attachment.

It is further preferred that detergent flow tube 52 extend in a flexible detergent supply conduit 82 similar to that described in connection with water supply conduit 80 downwards through the water/soap sprayer seat 94 formed in the sink 104 or the kitchen counter 96, to be connected to a liquid detergent depository 98 which is preferably mounted under the kitchen counter 96 in an easily accessible location. The water/soap sprayer seat 94 is preferably a metal or plastic cylinder extending through the sink 104 or counter 96, the metal or plastic cylinder having an internal diameter which is less than the external diameter of the handle of the water/soap sprayer 10. In this manner, the water/soap sprayer 10 of the present invention may be supported above the counter by the water/soap sprayer seat 94. The water supply conduit 80 and detergent supply conduit 82 extend downwards from handle section 12 through the water/soap sprayer seat 94 and are connected to the above-described outlets, and preferably each would have an overall length of between two (2) and five (5) feet to allow the water/soap sprayer 10 to be used in and around the sink area. The liquid detergent repository 98 includes an outflow valve 100 through which liquid detergent 60 may flow into the detergent flow tube 52 and flow into the water flow tube 34 as was described previously. Outflow valve 100 may be constructed as a one-way valve to prevent detergent back flow into the liquid detergent repository 98, although such a valve is not critical to the invention. In the preferred embodiment, the liquid detergent repository 98 would be a plastic container having a detergent capacity of approximately one quart, the liquid detergent repository 98 fastened to the underside of the kitchen counter 96 in a easily accessible location such that refill of the liquid detergent repository 98 with detergent 60 may be quickly and easily accomplished. Of course, the size and shape of the liquid detergent repository 98 is not critical to the present invention. The nozzle section 70 of water/soap sprayer 10 is best shown in FIGS. 2 and 6 as including a longitudinally extended generally conical sprayer nozzle 72 mounted at one end to the forward section 14 of handle section 12 and having at the opposite end thereof a releasable locking mechanism 74 adapted to releasably secure a variety of sprayer attachments thereon. FIG. 6 shows an annular brush attachment 76 mounted on the end of sprayer nozzle 72 by releasable locking mechanism 74. In the preferred embodiment, the annular brush attachment 76 and all other types of attachments to be used with the present invention would include two or more depending pins which would extend into and be secured by the releasable locking mechanism 74. The pins extend into gaps formed in the releasable locking mechanism 74. It is preferred that the pins each include a head section on the end thereof which have a greater diameter than the body of the pin. The gaps formed in the releasable locking mechanism 74 are of sufficient diameter to accept the head of the pin therein, the gap further including an arcuate slot formed adjacent thereto and connecting therewith, the arcuate slot having a width slightly greater than the diameter of the body of the pin but less than the diameter of the head of the pin. Therefore, when the pins are inserted into the gaps in releasable locking mechanism 74 and annular brush attachment 76 is rotated, the pins are rotated into the arcuate slots with the annular brush attachment 76 being secured on the releasable locking mechanism 74 due to the heads of the pins being secured underneath the arcuate slots due to the larger diameter of the heads of the pins. The same pin/slot arrangement may be used with other sprayer attachments, such as water flow directing nozzles, sponge heads, and other brush structures. Of course, any type of releasable locking mechanism may be used with the present invention so long as the purposes for which the releasable locking mechanism were designed are fulfilled.

Figure 7:
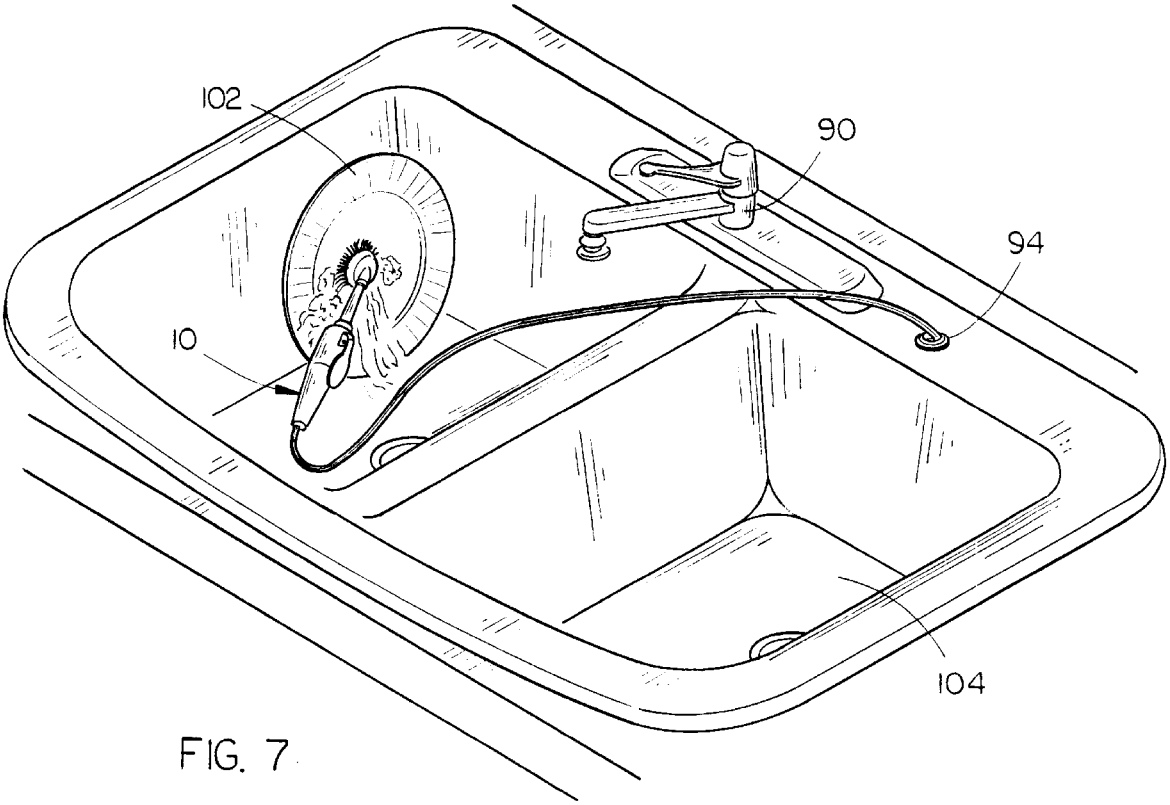
FIG. 7 is a perspective view of the sprayer unit being used to clean a dish within the sink.

FIG. 7 is a perspective view of the sprayer unit 10 of the present invention being used to clean a dish 102 within the sink 104 showing how water and detergent are ejected through the sprayer nozzle 72 and annular brush attachment 76 onto the surface of the dish 102 to allow for rapid and efficient cleaning of the dish. Following use of detergent on the dish 102, the water flow control valve lever 18 may be released slightly to release pressure on button 38 which controls soap control valve 36. Conical stopper 48 thus reseats in narrow opening 54 of detergent flow tube 52 thus preventing further release of detergent 60 through detergent flow tube 52. However, water flow through water flow tube 34 continues due to the continued pressure on water flow control valve lever 18 which keeps open water flow control valve 23. It should be noted that the ease and simplicity by which a dish 102 may be cleaned by the present invention is a substantial improvement over those devices found in the prior art due to the capability for control of both water flow and detergent flow from one location on the handle section 12 of water/soap sprayer 10.

It is to be understood that numerous additions, modifications and substitutions may be made to the present invention which fall within the intended broad scope of the appended claims. For example, the nature and structure of the various valves and fluid flow tube connections may be modified or changed so long as the detergent flow tube 52 connects into the water flow tube 34 at the Venturi passage section 56 of the water flow tube 34. Additionally, the exact size and shape of the water/soap sprayer 10 of the present invention may be modified or changed to provide any particular desired appearance so long as the functional characteristics of the invention are maintained. Finally, the construction materials used in the manufacture of the water/soap sprayer 10 of the present invention may be changed or modified should such modification prove desirable.

There has thus been shown and described a water/soap sprayer which accomplishes at least all of the stated objectives.

I claim:

1. A water/soap sprayer for attachment to a faucet comprising;

a sprayer unit including a handle section and a nozzle section having an outflow nozzle end;

a water flow conduit extending through said sprayer unit for transferring water through said sprayer unit and to said outflow nozzle end, said water flow conduit including a Venturi passage section for accelerating fluid flow therethrough;

a detergent flow conduit extending through said sprayer unit and in fluid connection with said Venturi passage section of said water flow conduit within said sprayer unit;

water flow control valve means mounted within said sprayer unit, said water flow control valve means operative to restrict and permit water flow through said water flow tube, said water flow control valve in said water flow conduit upstream from said Venturi passage section of said water flow conduit;

detergent flow control valve means mounted within said sprayer unit, said detergent flow control valve means operative to restrict and permit detergent flow into said Venturi passage section of said water flow conduit;

water flow control valve actuating means mounted on said sprayer unit and operatively connected to said water flow control valve means for actuating and controlling said water flow control valve means;

detergent flow control valve actuating means mounted on said sprayer unit forward of said water flow control valve actuating means and being operatively connected to said water flow control valve means for actuating and controlling said detergent flow control valve means;

a pivotably mounted water flow control valve lever mounted on the exterior of said handle section of said sprayer unit, said lever operative to engage and actuate said water flow control valve actuating means;

said water flow control valve lever being pivotably mounted on said handle section forward of said water flow control valve actuating means and said detergent flow control valve actuating means whereby upon said lever being pivoted downwards towards said sprayer unit, said lever first actuates and controls said water flow control valve means, and upon being pivoted downwards farther, engages said detergent flow control valve means, whereby said water flow control valve means and said detergent flow control valve means are capable of actuation and control by use of said pivoting water flow control valve lever;

a flexible water supply conduit connected at one end thereof to said water flow conduit opposite said outflow nozzle end and adapted for connection at the opposite end thereof to a water source;

a flexible detergent supply conduit connected at one end thereof to said detergent flow conduit opposite said connection to said Venturi passage section of said water flow conduit, the opposite end of said detergent supply conduit adapted for connection to a liquid detergent source; and said sprayer unit operative to clean items by actuation of said water flow control valve means and said detergent flow control valve means whereby a water/detergent mix is output through said nozzle section of said sprayer unit and out of said sprayer unit through said outflow nozzle end.

2. The water/soap sprayer of claim 1 wherein said water flow control valve comprises a generally upright, movably mounted water valve control rod mounted beneath said lever such that depression of said lever results in depression of said control rod, said water flow control valve further including biasing means for biasing said control rod upwards to pivot said lever upwards.

3. The water/soap sprayer of claim 1 wherein said detergent flow control valve actuating means comprises a movably mounted button mounted atop a detergent valve rod which extends inwards into said handle section of said sprayer unit, said detergent flow control valve actuating means further including biasing means operative bias valve rod upwards, thereby extending said button above the exterior of said handle section.

4. The water/soap sprayer of claim 1 wherein said detergent flow control valve actuating means further comprises said detergent valve rod extending inwards and operatively connecting with said detergent flow control valve means.

5. The water/soap sprayer of claim 4 wherein said detergent flow control valve comprises a needle valve assembly including an upwardly projecting generally conical stopper within said detergent flow tube which is biased upwards through connection to said detergent valve rod.

6. The water/soap sprayer of claim 5 wherein said detergent flow tube further includes a narrowed portion which connects with said water flow tube, said conical stopper extending into said narrowed opening of said detergent flow tube thereby sealing said opening when said stopper is biased upwards, whereby detergent flow through said detergent flow tube is restricted.

7. The water/soap sprayer of claim 6 wherein said detergent flow control valve means is operative to permit detergent flow through said detergent flow tube upon depression of said button which moves said detergent valve rod downwards, thereby moving conical stopper downwards and allowing detergent flow through said narrow opening into said water flow tube.

8. A water/soap sprayer for attachment to a faucet comprising;

a sprayer unit including a handle section and a nozzle section having an outflow nozzle end;

a water flow conduit extending through said sprayer unit for transferring water through said sprayer unit and to said outflow nozzle end, said water flow conduit including a Venturi passage section for accelerating fluid flow therethrough;

a detergent flow conduit extending through said sprayer unit and in fluid connection with said Venturi passage section of said water flow conduit within said sprayer unit;

water flow control valve means mounted within said sprayer unit, said water flow control valve means operative to restrict and permit water flow through said water flow tube, said water flow control valve in said water flow conduit upstream from said Venturi passage section of said water flow conduit;

detergent flow control valve means mounted within said sprayer unit, said detergent flow control valve means operative to restrict and permit detergent flow into said Venturi passage section of said water flow conduit;

water flow control valve actuating means mounted on said sprayer unit and operatively connected to said water flow control valve means for actuating and controlling said water flow control valve means;

detergent flow control valve actuating means mounted on said sprayer unit and operatively connected to said water flow control valve means for actuating and controlling said detergent flow control valve means;

a pivotably mounted water flow control valve lever mounted on the exterior of said handle section of said sprayer unit, said lever operative to engage and actuate said water flow control valve actuating means;

said water flow control valve means further including a generally upright, movably mounted water valve control rod mounted beneath said lever such that depression of said lever results in depression of said control rod, said water flow control valve further including biasing means for biasing said control rod upwards to pivot said lever upwards and a force transference wheel to which the lower end of said control rod is pivotably connected, said wheel rotatably mounted in said handle section of said sprayer unit;

a flexible water supply conduit connected at one end thereof to said water flow conduit opposite said outflow nozzle end and adapted for connection at the opposite end thereof to a water source;

a flexible detergent supply conduit connected at one end thereof to said detergent flow conduit opposite said connection to said Venturi passage section of said water flow conduit, the opposite end of said detergent supply conduit adapted for connection to a liquid detergent source; and said sprayer unit operative to clean items by actuation of said water flow control valve means and said detergent flow control valve means whereby a water/detergent mix is output through said nozzle section of said sprayer unit and out of said sprayer unit through said outflow nozzle end.

9. The water/soap sprayer of claim 8 wherein said water flow control valve further comprises a valve rod pivotably connected to said force transference wheel, said valve rod extending rearwards from said wheel, said water flow control valve further including a plunger mounted on the rearward end of said valve rod, said plunger seated on an annular ring mounted concentrically within said water flow conduit for restricting and permitting water flow therethrough.

10. The water/soap sprayer of claim 9 wherein said water flow control valve is operative to permit water flow through said water flow conduit upon depression of said lever which depresses said control rod thereby rotating said wheel which translates the vertical force from said control rod to said valve rod, thus moving said valve rod rearwards thereby moving said plunger rearwards away from a seated position on said annular ring to an open position which allows for water flow through said water flow tube.

* * * * *